US007470150B2

(12) United States Patent
Kuo et al.

(10) Patent No.: US 7,470,150 B2
(45) Date of Patent: Dec. 30, 2008

(54) CABLE CONNECTOR ASSEMBLY WITH SIMPLIFIED GROUNDING PATH

(75) Inventors: Peter Kuo, Tu-cheng (TW); Chin-Pao Kuo, Tu-cheng (TW); Zhi-Yong Li, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/641,418

(22) Filed: Dec. 19, 2006

(65) Prior Publication Data

US 2007/0141907 A1 Jun. 21, 2007

(30) Foreign Application Priority Data

Dec. 19, 2005 (CN) ..... 2005 1 0022595

(51) Int. Cl.
*H01R 9/03* (2006.01)

(52) U.S. Cl. ..... 439/610

(58) Field of Classification Search ..... 439/610, 439/607, 579, 108, 497
See application file for complete search history.

(56) References Cited

U.S. PATENT DOCUMENTS 4,155,615 A * 5/1979 Zimmerman et al. ..... 439/71
4,602,832 A * 7/1986 Cunningham et al. ..... 439/108
4,781,620 A 11/1988 Tengler
6,109,976 A * 8/2000 van Zanten et al. ..... 439/689
6,123,582 A * 9/2000 Ko et al. ..... 439/579
6,390,852 B1 5/2002 Wang
6,544,050 B1 4/2003 Ko
6,645,007 B1 11/2003 Ko
6,755,687 B1 * 6/2004 Ko ..... 439/579
7,052,311 B2 * 5/2006 Kondou et al. ..... 439/497

* cited by examiner

*Primary Examiner*—Alexander Gilman
(74) *Attorney, Agent, or Firm*—Wei Te Chung

(57) ABSTRACT

A cable connector assembly (100) used in high frequency signal transmission filed includes an insulative housing (2), a conductive terminals (3) retained in the housing, a number of wires (4) arrayed in a row and electrically connecting the terminals, and a conductive shell (5). The wires comprise at least one signal wire (40*b*) each comprising one or more conductive cores (401*b*) at the innermost thereof, and a grounding layer (403*b*) surrounding and shielding said core. The conductive shell comprises a base portion (510, 511, 520) shielding said housing and a soldering portion (521) integral with and behind said base portion. Each grounding layer abuts against and is soldered with said soldering portion of the shell, thereby simplifying grounding path.

5 Claims, 6 Drawing Sheets

CABLE CONNECTOR ASSEMBLY WITH SIMPLIFIED GROUNDING PATH

BACKGROUND OF THE INVENTION

1. Field of the Invention

This invention generally relates to a cable connector assembly, and more particularly, to a cable connector assembly used in high frequency signal transmission.

2. Description of the Prior Art

It is well known in the art that a grounding device is often used to reduce the crosstalk in an electrical connector, and particularly to reduce the crosstalk in an electrical connector terminating with a coaxial wire for transmitting data at a high speed. Such an electrical connector having a relevant grounding bus is disclosed in U.S. Pat. No. 4,781,620. The grounding bus has a base strip portion, and a plurality of axially rearwards extending tab-like fingers arranged in a row extending widthwise of the wire and bent to juxtaposition with the bent bared portions of the coaxial shield. The grounding bus connects the braidings of the coaxial wire with the grounding contacts of the electrical connector so as to establish a grounding path therebetween for crosstalk prevention. However, soldering the grounding bus to the braidings decreases the assembly efficiency compared with a simple mechanical engagement therebetween. Meanwhile, the grounding bus and the grounding contacts are partially insert molded, which also complicates the manufacture.

In U.S. Pat. No. 6,123,582, a cable connector assembly for contacting with a mating electrical connector includes a first and a second housing members, a wire with a plurality of wires, an upper and a lower shield members, and a plurality of contacts. Each wire has a central signal conductor and a grounding braiding layer around the signal conductor. The connector assembly is horizontally mated with the mating connector. A grounding bar is soldered to the grounding braiding of the wires. The upper and lower shield members attached onto the first housing member are engagingly jointed with each other and electrically contact with a shield member of the mating connector. Meanwhile, the upper shield member further forms a plurality of spring fingers extending inside the first housing member to electrically engage with the grounding bar received therein. Therefore, a grounding path from the wire to the mating connector is established. The grounding bar electrically connecting all the wires advances the capability in grounding, but it is a trouble to assemble the grounding bar on the wire.

U.S. Pat. No. 6,390,852 discloses a cable connector assembly including a wire set and an electrical connector. The wire set has a plurality of signal wires, a grounding wire and a shielding braid layer surrounding both the signal wires and the grounding wire. The connector has a dielectric housing with a plurality of terminals mounted therein, an upper shell and a lower shell defining a receiving space for receiving the housing therein. The upper shell comprises a rectangular panel, a collarlike strip connecting to the rectangular panel, and a pair of side panels. The lower shell includes a top plate, a bottom plate and side plates each defining a soldering tab thereon. The grounding wire is soldered to a soldering tab and the signal wires are soldered to corresponding terminals. The strip is crimped to the wire set. However, a grounding wire is required, and the juncture between the grounding wire and the soldering tab is not very reliable.

Hence, an improved cable connector assembly is desired to overcome the above problems and meet the increasing transmission demand.

BRIEF SUMMARY OF THE INVENTION

It is an object of the present invention to provide a cable connector assembly with simplified grounding path.

In order to attain the object above, a cable connector assembly used in the high frequency transmission field according to the present invention comprises an insulative housing adapted for mating with a complementary connector, a conductive terminals retained in the housing, a plurality of wires arrayed in a row along a longitudinal direction and electrically connecting the terminals, and a conductive shell. The wires comprises at least one signal wire each comprising one or more conductive cores at the innermost thereof and a grounding layer surrounding and shielding said cores. The conductive shell comprises a base portion shielding said housing and a soldering portion integral with and behind said base portion. Each grounding layer abuts against and is soldered with said soldering portion of the shell, thereby simplifying grounding path.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
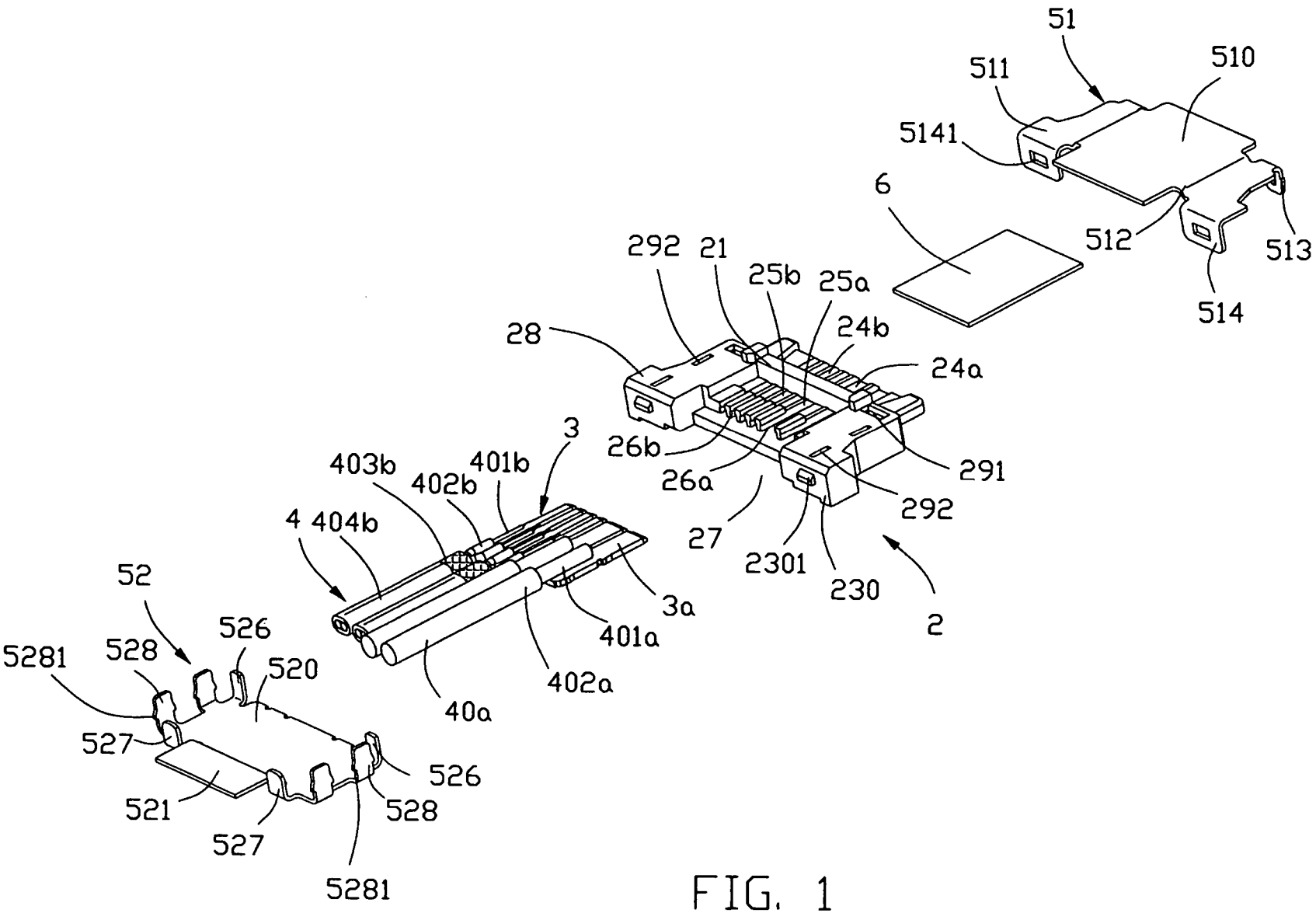
FIG. 1 is an exploded, perspective view of a cable connector assembly in accordance with the present invention.
Figure 2:
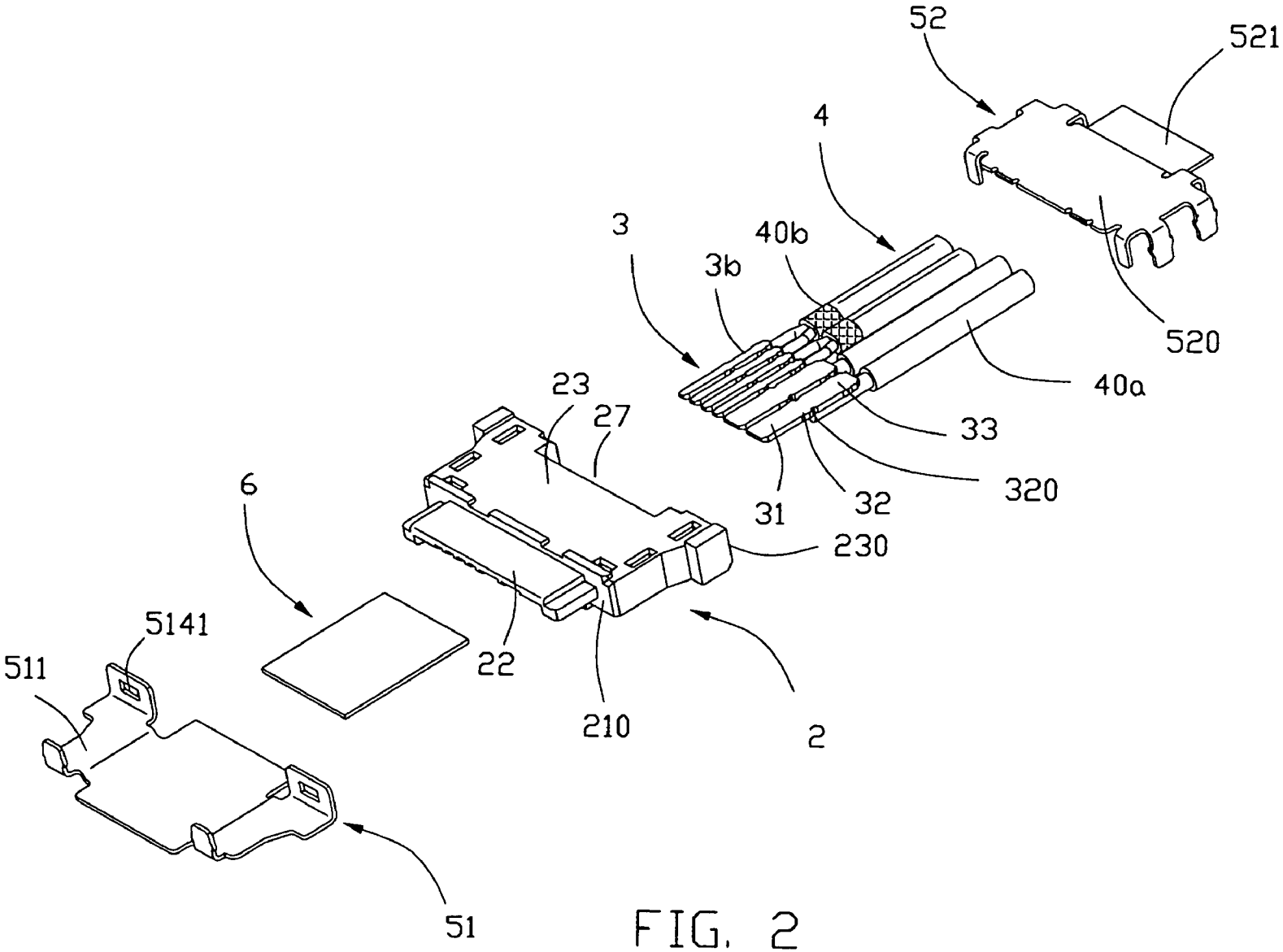
FIG. 2 is a view similar to FIG. 1, but viewed from another aspect.

As shown in FIGS. 1-2, a cable connector assembly 100 according to the present invention comprises an insulative housing 2, a plurality of conductive terminals 3 held in the housing 2, a plurality of wires 4 electrically communicating with the terminals 3, and a conductive shell 5 shrouding the housing 2.

The conductive shell 5 comprises an upper shell 51 and a lower shell 52 engagable with the upper shell 51. The upper shell 51 comprises a rectangular base portion 510, a pair of wing portions 511 slightly lower than the base portion 510 and extending outwards from opposite lateral sides of the base portion 510, and a pair of middle portions 512 connecting the base portion 510 and the wing portions 511. The rear end of each wing portion 511 is wider than other parts of the wing portion 511. A pair of first fingers 513 with several agnails (not labeled) extend downwards from the front of the wing portions 51, and a pair of second fingers 514 with two rectangular holes 5141 defined therein extend downwards from the rear edges of the wing portions 51 to hold the shell 5 on the housing 2.

The lower shell 52 comprises a rectangular base portion 520, and a rectangular soldering portion 521 higher than the base portion 520 and extending rearwards from the base portion 520. Two pairs of third fingers 526, 527 respectively extend downwards from the front and rear edges of the base portion 520, and two pairs of fourth fingers 528 with four pair of barbs 5281 formed thereon extend downwards from opposite lateral sides of the base portion 520 to hold the lower shell 52 on the housing 2. The soldering portion 521 is flat.

The insulative housing 2 comprises a rod 21 and a main portion 23 extending rearwards from the rod 21. The housing 2 further comprises a mating surface 210 and a jointing surface 230 opposite to the mating surface 210. A tongue plate 22 projects forwardly from the mating surface 210 for inserting into a complementary connector (not shown). An ear portion 28 protrudes outwardly from each lateral side of the main portion 23. A receiving space 27 is defined in a rear portion of the main portion 23 and between the pair of ear portions 28 for receiving the soldering portion 521 of the lower shell 52. A plurality of passageways are defined through the insulative housing 2 and comprises a plurality of wire-receiving passageways 26*a*, 26*b* defined in the main portion 23, a plurality of middle passageways 25*a*, 25*b* defined through the rod 21 in communication with the wire-receiving passageways 26*a*, 26*b*, and a plurality of terminal-receiving slots 24*a*, 24*b* defined in the tongue plate 22 and communicating with corresponding middle passageways 25*a*, 25*b* defined in the rod 21. The wire-receiving passageways 26*a* are spaced from each other at a relatively large distance for receiving corresponding terminals 3 for power transmission. The wire-receiving passageways 26*b* are spaced from each other at a relatively small distance for receiving corresponding terminals 3 for signal transmission. So do the middle passageways 25*a*, 25*b* and the terminal-receiving slots 24*a*, 24*b*. A front portion of each wire-receiving passageways 26*a*, 26*b* is relatively wide for receiving a portion of a corresponding terminal 3 therein. A pair of first through holes 291 and two pairs of second through holes 292 are respectively defined adjacent to opposite lateral sides of the rod 21, and in opposite lateral sides of the ear portions 28 for engaging with the conductive shell 5. A pair of protrusions 2301 are formed on the jointing surface 230 for engaging with the rectangular holes 5141 of the upper shell 51.

Figure 3:
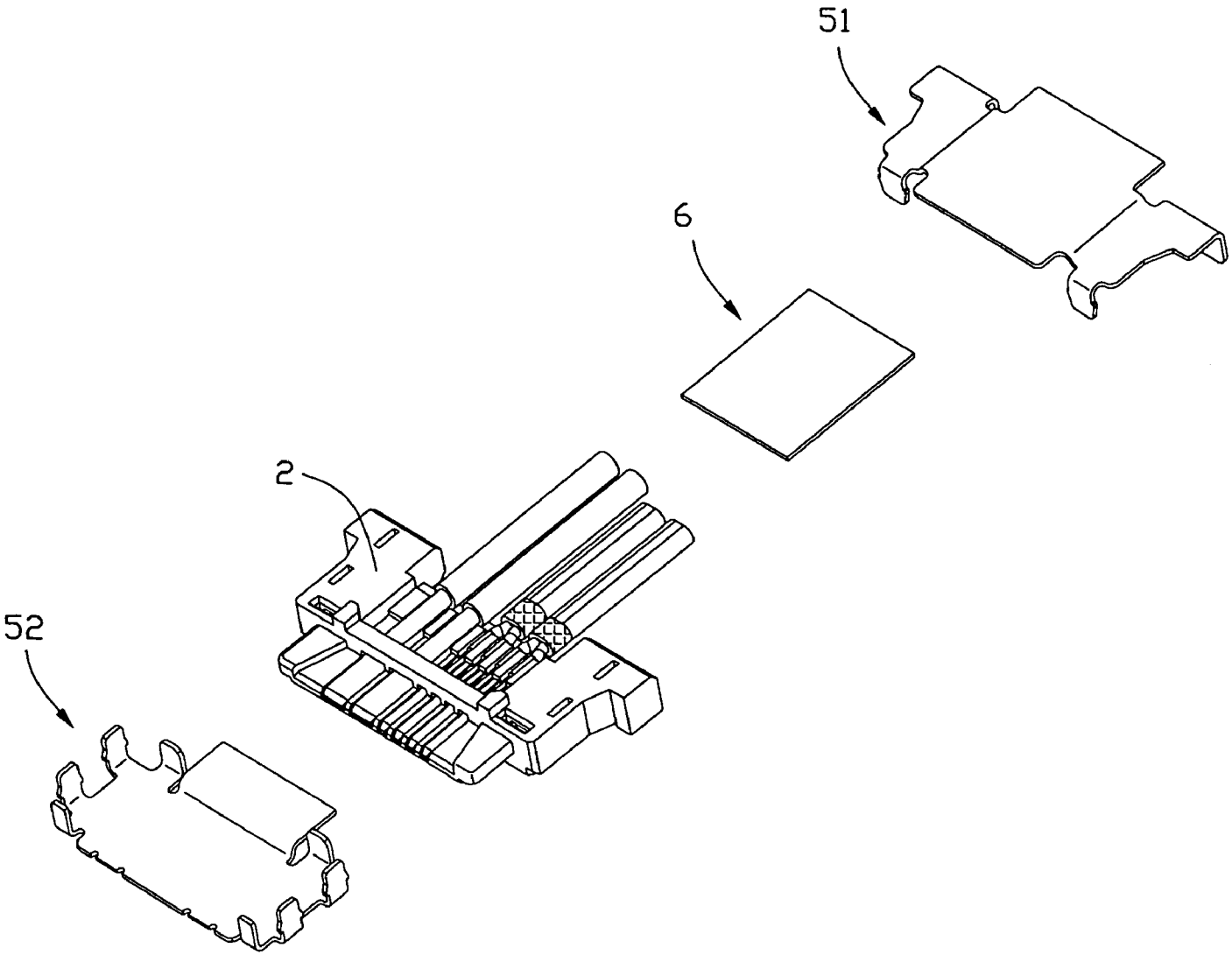
FIG. 3 is a perspective view after assembling wires on a housing of the cable connector assembly shown in FIG. 1.

Now referring to FIGS. 1-3, a detailed description of the terminals 3 will be provided. The terminals 3 comprise a plurality of power terminals 3*a* with large size spaced from each other at a relatively large distance for power transmission, and a plurality of signal terminals 3*b* with small size spaced from each other at a relatively small distance for signal transmission. Each terminal 3 comprises a retention portion 32, a mating portion 31 extending forwardly from the retention portion 32 for mating with a corresponding terminal of the complementary connector, and a tail portion 33 extending rearwards from the rear side of the retention portion 32 for being soldered to a wire 4. A plurality of barbs 320 is formed on opposite lateral sides of the retention portion 32 for engaging with a corresponding middle passageway 25*a*, 25*b* defined in the rod 21.

Figure 4:
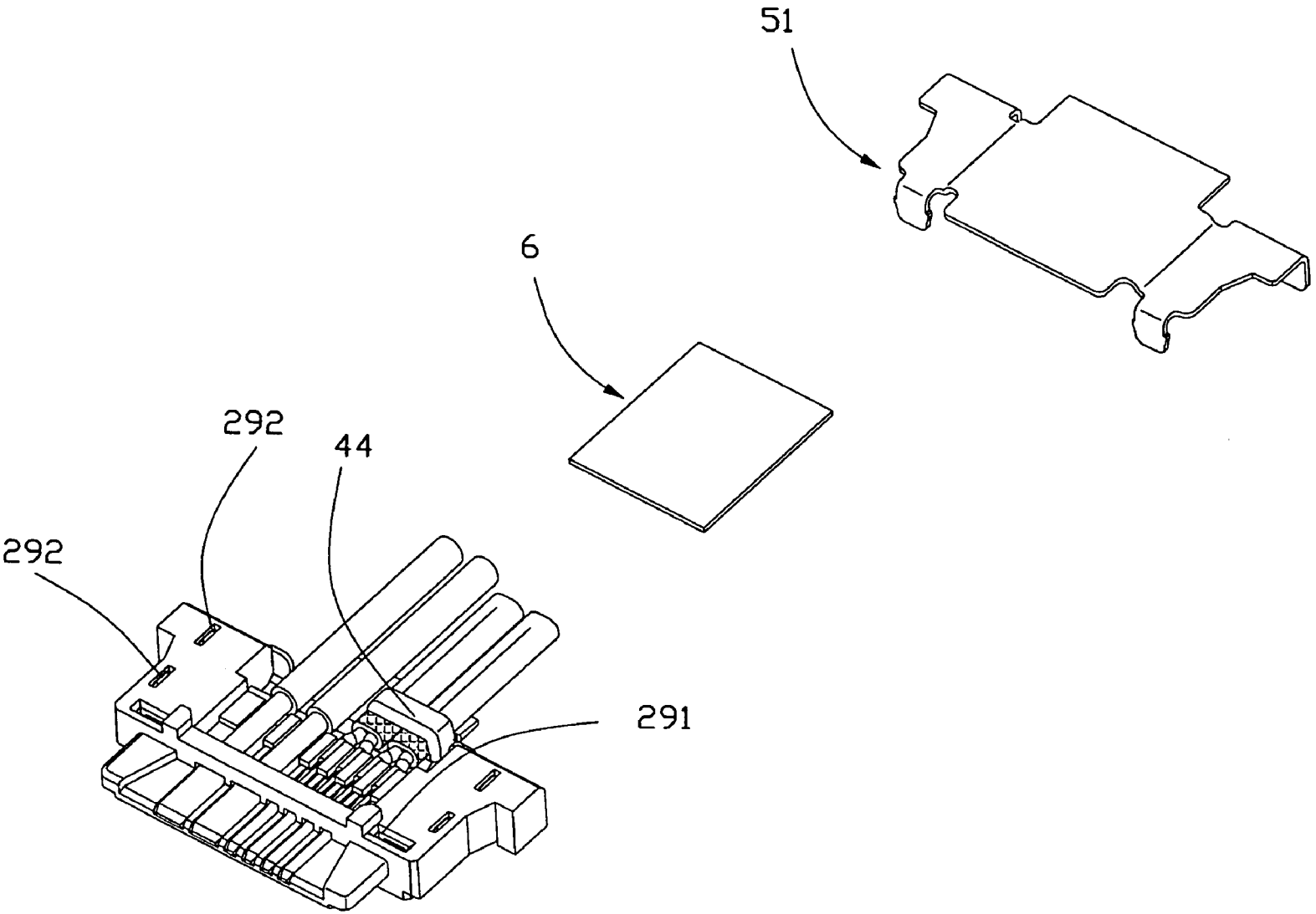
FIG. 4 is a perspective view after soldering wires to a lower shell of the cable connector assembly shown in FIG. 3.
Figure 5:
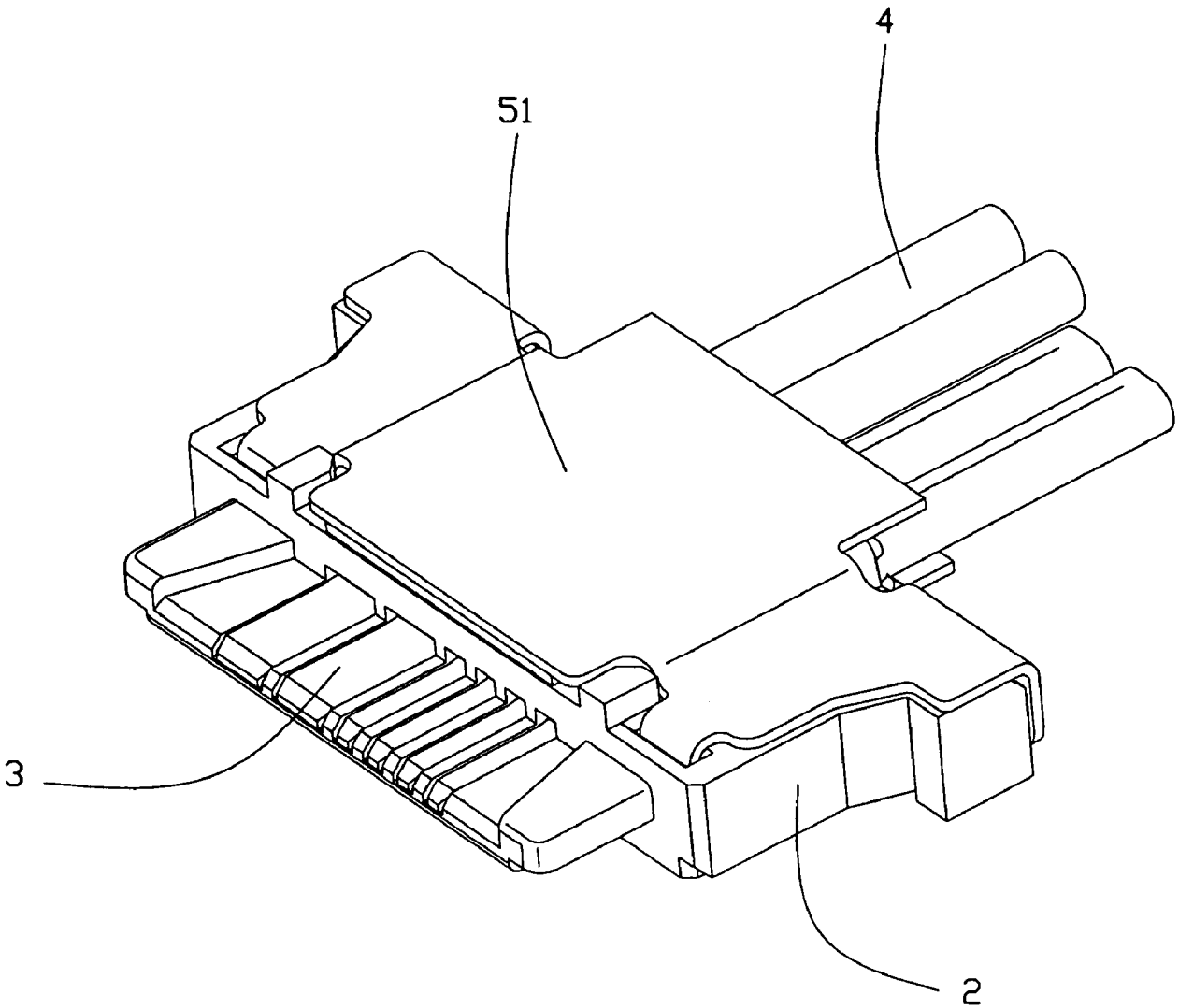
FIG. 5 is an assembled view of the cable connector assembly shown in FIG. 1.
Figure 6:
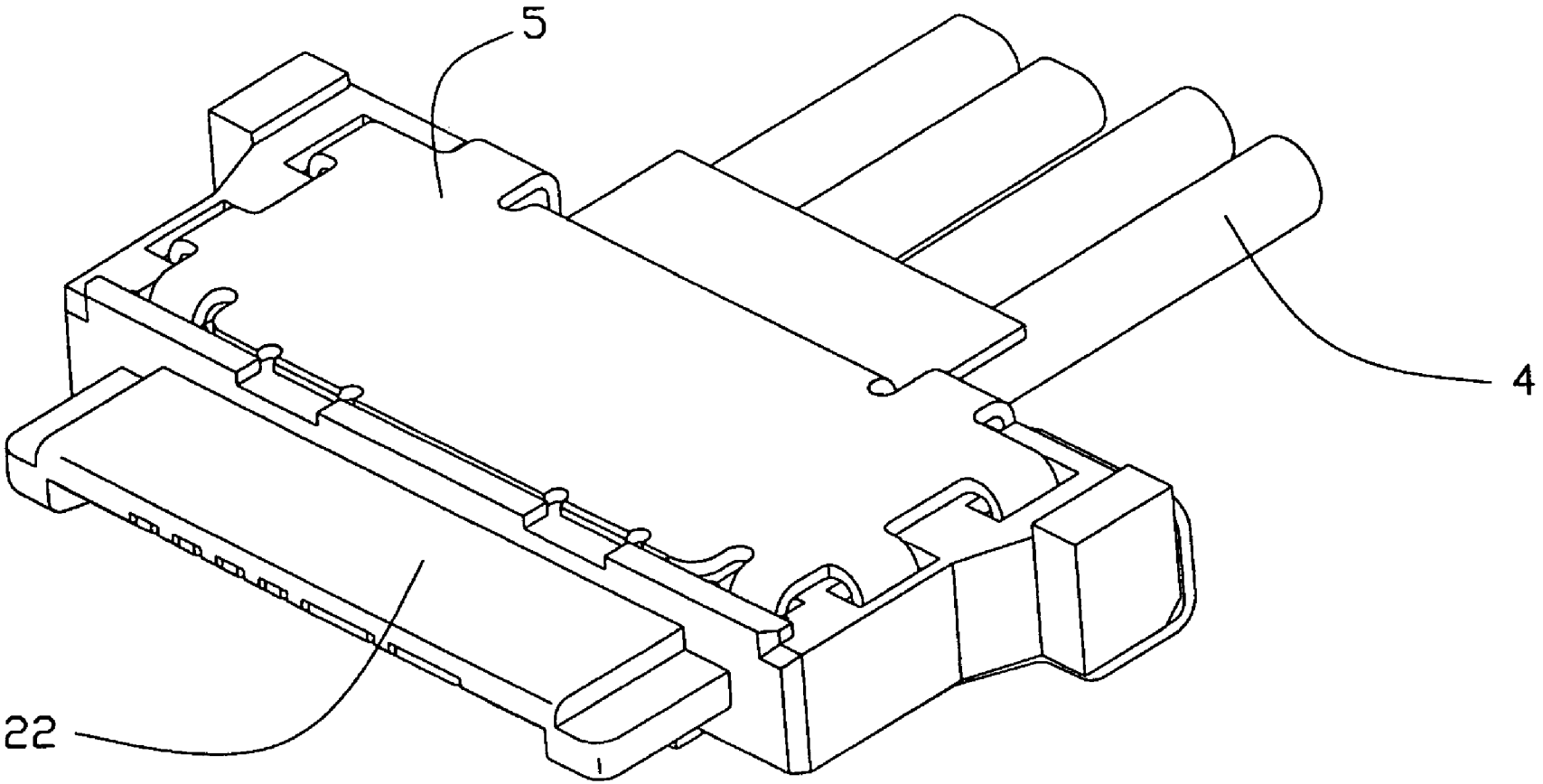
FIG. 6 is a view similar to FIG. 5, but viewed from another aspect.

Referring to FIGS. 1-2 in conjunction with FIGS. 3 and 4, the wires 4 consist of a row of juxtaposed round wires. The wires comprise a plurality of power wires 40*a* with large size for power transmission, and a plurality of signal wires 40*b* with small size for signal transmission. Each power wire 40*a* is composed of an outer jacket 402*a* at the outmost thereof, and a conductive core 401 a at the innermost thereof. Each signal wire 40*b* is composed of an outer jacket 404*b* at the outmost thereof, a grounding layer 403*b* formed below the outer jacket 404*b*, a pair of inner insulative layers 402*b* formed below the grounding layer 402*b*, and a pair of conductive cores 401*b* at the innermost thereof. The grounding layer is a metal braid layer. The outer jacket 402*a* of each power wire 40*a* is stripped off at a front end thereof to expose the conductive core 401*a* as a power segment which extends into the wire-receiving passageways 26*a*. The outer jacket 404*b* of each signal wire 40*b* is stripped off at a front end thereof to expose the grounding layer 403*b* as being a grounding segment of the wire 40*b*. The grounding segment of each signal wire 40*b* is then respectively soldered with an inner surface of the soldering portion 521 of the lower shell 52. Each signal wire 40*b* in part is further stripped off to expose the conductive cores 401*b* as being a signal segment which extends into the wire-receiving passageways 26*b* for electrically connecting corresponding terminals 3*b*.

Referring to FIGS. 3-6, in assembly, firstly, the terminals 3 are inserted into the passageways along the back-to-front direction with the mating portions 31 received in the terminal-receiving slots 24*a*, 24*b*, the retention portions 32 received in the middle passageways 25*a*, 25*b*, the tail portions 33 received in the wire-receiving passageways 26*a*, 26*b*. Secondly, the lower shell 52 is assembled onto the housing 2 along a vertical direction perpendicular to the back-to-front direction with the third and fourth finger 526, 528 being respectively received in the first and second through holes 291, 292 of the housing 2. Thirdly, the wires 4 are assembled onto the housing 2, accordingly, the conductive cores 401*a*, 401*b* extending into wire-receiving passageways 26*a*, 26*b* to be soldered with the tail portions 33 of the terminals 3, parts of the wires 4 abutting against the soldering portion 521, and the grounding layers 403*b* which are exposed outside standing above the soldering portion 521. Fourthly, a tin stick 44 is placed on the exposed grounding layers 403*b* and heated. A molten stick 44 will solder the grounding layers 403*b* with the soldering portion 521 of the lower shell 52. After the molten stick 44 freezes, it reinforces the junction between the grounding layers 403*b* and the soldering portion 521. Finally, a Kapton tape 6 is stuck to an inner surface of the base portion 510 of the upper shell 51 in order to insulate the upper shell 51 on the housing 2 from the terminals 3 and wires 4. The upper shell 51 is assembled onto the housing 2 with the first fingers 513 received in the first through holes 291, and the rectangular holes 5141 of the second fingers 514 receiving the protrusions 2301 which are formed on the jointing surface 230.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly, comprising:

an insulative housing adapted for mating with a complementary connector;

a plurality of conductive terminals held in the housing;

a plurality of wires arrayed in a row along a longitudinal direction and electrically connecting corresponding terminals, said wires comprising at least two signal wires each comprising one or more conductive cores at the innermost thereof and a grounding layer surrounding and shielding said cores; and a conductive shell including a base portion shielding said housing and a soldering portion formed integral with said base portion and extending along said longitudinal direction to mechanically connect all the plurality of wires, each of the grounding layers of said at least two signal wires abutting against and soldered with said soldering portion of the conductive shell; wherein the soldering portion of the shell locates behind the insulative housing.

2. The cable connector assembly according to claim 1, wherein the insulative housing defines a receiving space at the rear end of the housing for receiving said soldering portion.

3. A cable connector assembly comprising:

an insulative housing adapted for mating with a complementary connector;

a plurality of conductive terminals held in the housing;

a plurality of wires arrayed in a row along a longitudinal direction and electrically and mechanically connecting corresponding terminals, said wires comprising signal wires each comprising at least one core at the innermost thereof to connect to the corresponding terminal and a grounding layer surrounding and shielding said core; and a conductive shell including a cover portion downwardly shielding said housing and joint portions formed by ends of the wires and the corresponding terminals; wherein an insulator is sandwiched between the cover portion and the joint portions for isolation while the cover portion directly mechanically and electrically connecting to the grounding layer.

4. The cable connector assembly as claimed in claim 3, wherein said insulator defines a configuration in compliance with the covering portion rather than the joint portions.

5. The cable connector assembly as claimed in claim 3, wherein the covering portion includes a first part engaged with the insulator, and a second part engaged with the grounding layer, under a condition that the first part and the second part are respectively located by two opposite sides of said wires.

* * * * *